United States Patent [19]

Papajewski et al.

[11] Patent Number: 4,699,302

[45] Date of Patent: Oct. 13, 1987

[54] DEVICE FOR PRODUCING WAISTBANDS IN GARMENTS

[75] Inventors: Gerd H. Papajewski, Stutensee-Friedrichstal; Michael G. Rögner, Karlsruhe-Durlach, both of Fed. Rep. of Germany

[73] Assignee: Pfaff Aktiengesellschaft, Fed. Rep. of Germany

[21] Appl. No.: 936,471

[22] Filed: Nov. 25, 1986

[51] Int. Cl.[4] ..... D05B 21/00; D05B 35/08

[52] U.S. Cl. ..... 223/38; 112/121.27; 112/147

[58] Field of Search ..... 223/38, 37; 112/121.27, 112/121.26, 147, 136, 137, 138, 10, 152

[56] References Cited

U.S. PATENT DOCUMENTS

| | | | |
|---|---|---|---|
| 2,776,636 | 1/1957 | Seserman | 112/147 |
| 3,865,058 | 2/1975 | Rovin et al. | 112/10 X |
| 3,994,247 | 11/1976 | Cummins | 112/121.26 |
| 4,184,439 | 1/1980 | Schulz | 112/152 X |
| 4,280,421 | 7/1981 | Price | 112/147 |
| 4,389,957 | 6/1983 | Block et al. | 112/121.27 X |
| 4,606,287 | 8/1986 | Papajewski et al. | 112/121.27 |

*Primary Examiner*—Ronald Feldbaum
*Assistant Examiner*—J. L. Olds
*Attorney, Agent, or Firm*—McGlew and Tuttle

[57] ABSTRACT

A folding device folds waistband ends into the waistband and the device moveable along with folding tools, clamping tools and engagement fingers in a way which allows the fingers to be inserted between layers of the waistband and moved the working area of a bar tacking machine, while clamping tools and folding tools are moved away from the finger so that they do no impede the inserting process. The control of the fingers and folding tools of the folding device is made more simple and economical by the use of control cams.

2 Claims, 5 Drawing Figures

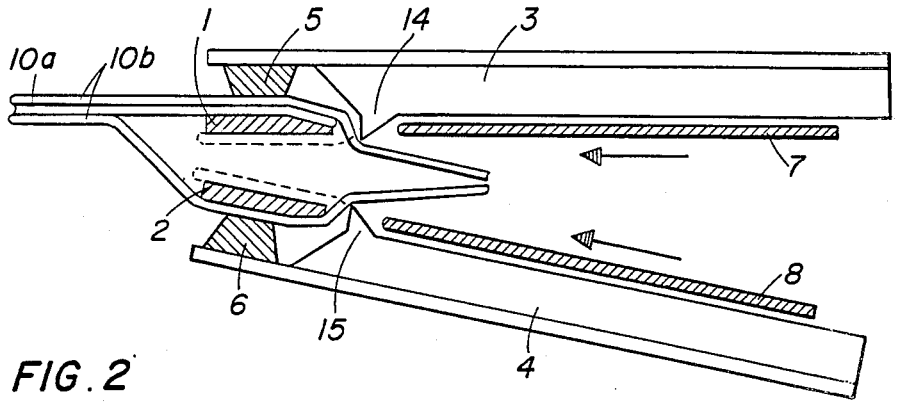
FIG. 2
FIG. 3
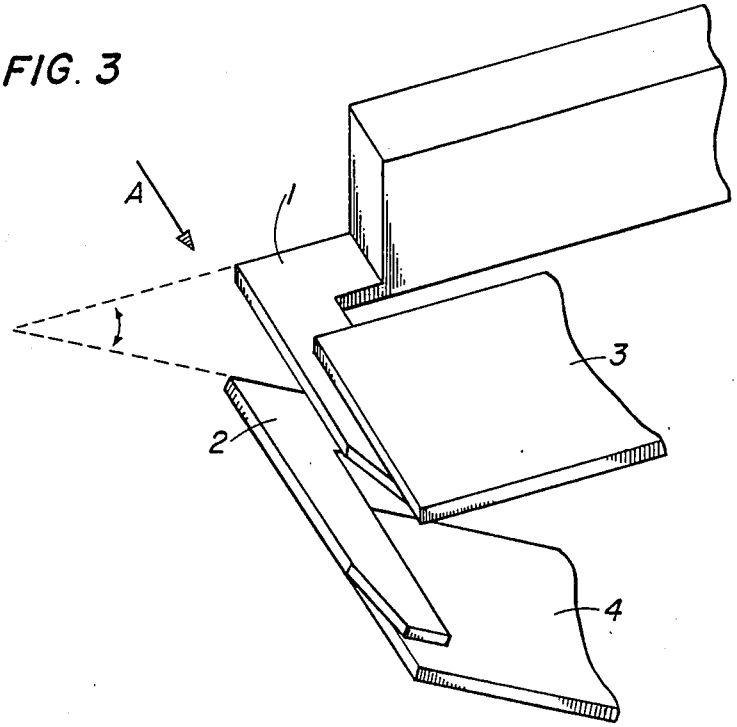

11
1
2
17
16

DEVICE FOR PRODUCING WAISTBANDS IN GARMENTS

BACKGROUND OF THE INVENTION

1. Field of the Invention

This invention relates in general garment forming devices and in particular to a new and useful device for producing waist bands on garments.

After a U-shaped waistband is sewn onto the rim of a garment part for example a trouser, it necessary to fold the protruding waistband end into the waistband in a manner that the folded end of the waistband lays in a line with the side edge of the garment part. After this procedure the waistbands are fixed by a sewn bar tack.

A folding device is known which folds the protruding waist band ends automatically into the waistband as shown in (U.S. Pat. No. 4,606,287).

The disadvantage of this folding device are that the unloading of the folded waistband ends from the folding device and the loading of the folded waistband ends into the bar-tacking machine have to be performed by hand.

Furthermore the clamping tools and the folding tools are arranged in a very disadvantageous way around the fingers. That means that when the clamping tools and folding tools are moved away from the fingers, there is not enough space around the fingers and therefore an inserting of the fingers with the folded waistband end into the bar-tacking machine is impossible. Another folding device is that the activation and the control of the folding tools and the fingers by an air-cylinder aggregate is very costly.

SUMMARY OF THE INVENTION

The present invention provides a folding device which allows the automation of the whole waistband end producing process from the loading of the garment parts with the protruding waistband ends in the folding device to the unloading of the garment parts with the finished waistband ends from the bar-tacking machine.

According to the invention the folding device is movable and is supplied with two moveable brackets on which clamping tools and folding tools are arranged. The brackets with the folding and clamping tools can be moved away from the fingers in a position which allows insertion at the fingers with the folded waistband ends into the working area of the bar-tacking machine.

The control of the folding device can be simplified by using cams for the control of the fingers and the folding tools.

The brackets including the clamping tools are controlled by air cylinder and piston arrangement.

One advantage of the invention is the complete automation of the waistband end producing process from the loading of the garment parts with the attached waistband end in the folding device to the unloading thereof from a bar tacking machine.

Another advantage is the simplified control of the folding device that the device permits rapid processing and therefore is a more economical producing process.

Accordingly there is an object of the invention to provide an improved device for handling garments in the formation of waistband in which permits the folding of two layers of the garments to a waistband configuration and for positioning the garment after folding into association with means for securing the waistband layers in the folded condition to form a waistband.

A further object of the invention is to provide a device for facilitating the formation and handling of garments an effecting waistbands there on which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is a partial elevational and sectional view in the direction of arrow A of FIG. 3 which shows the open waistband end;

FIG. 3 is a perspective view similar to FIG. 1 showing the divergent fingers and the brackets which are moved into a position close to the fingers;

GENERAL DESCRIPTION OF THE PREFERRED EMBODIMENTS

Figure 4:
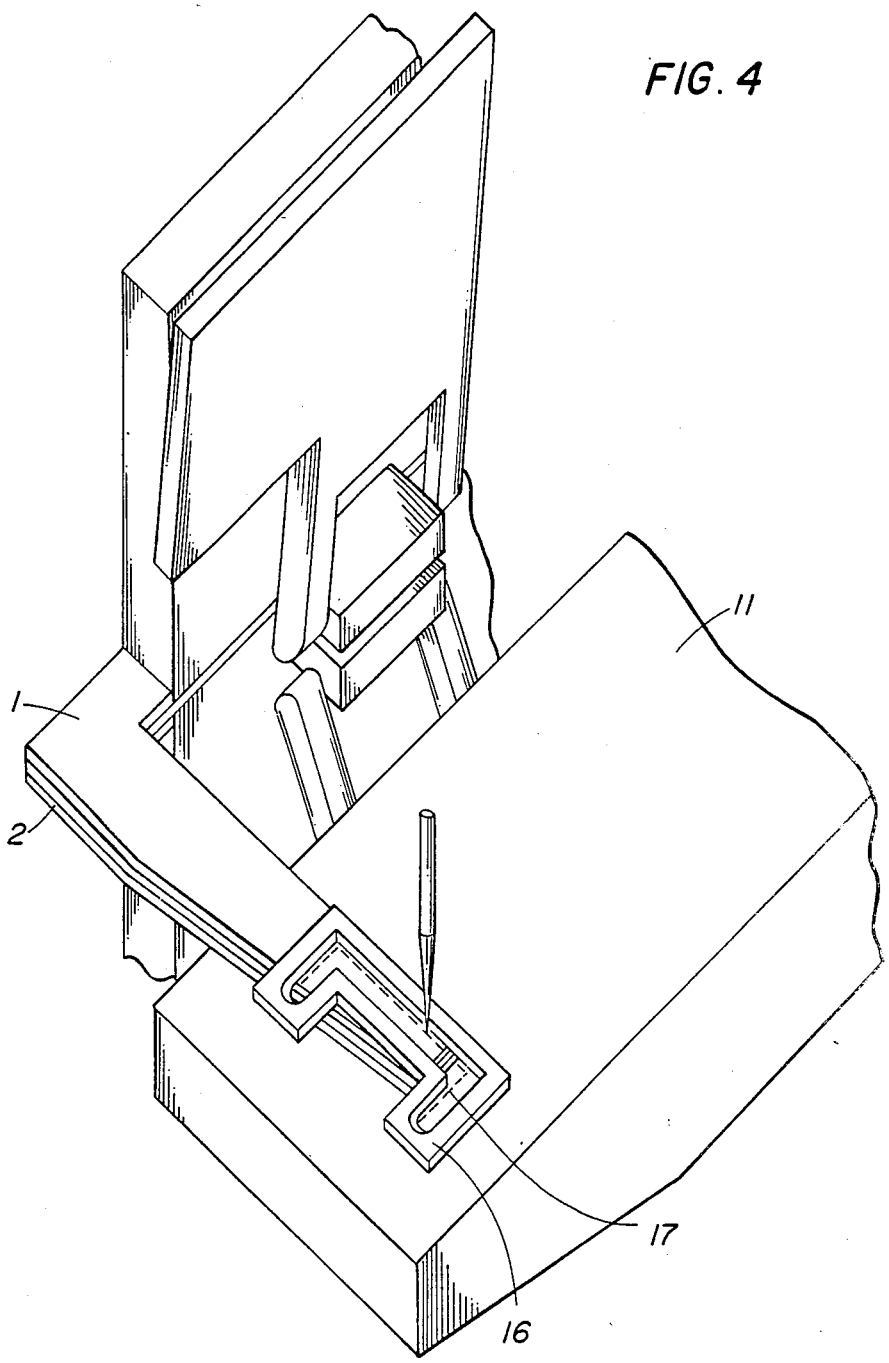
FIG. 4 is a perspective view similar to FIG. 1 but with the fingers positioned in the working area of the bar taking machine (11)

Referring to the drawings in particular the invention embodied therein comprises a device for producing waistbands on garments 10 which included plurality of layers such as layers 10*a*, 10*b* shown in FIG. 2 which are folded adjacent therein to form overlapped areas which must be secured together by a securing apparatus such as a bar tacking machine designated at 11 FIG. 4.

Figure 1:
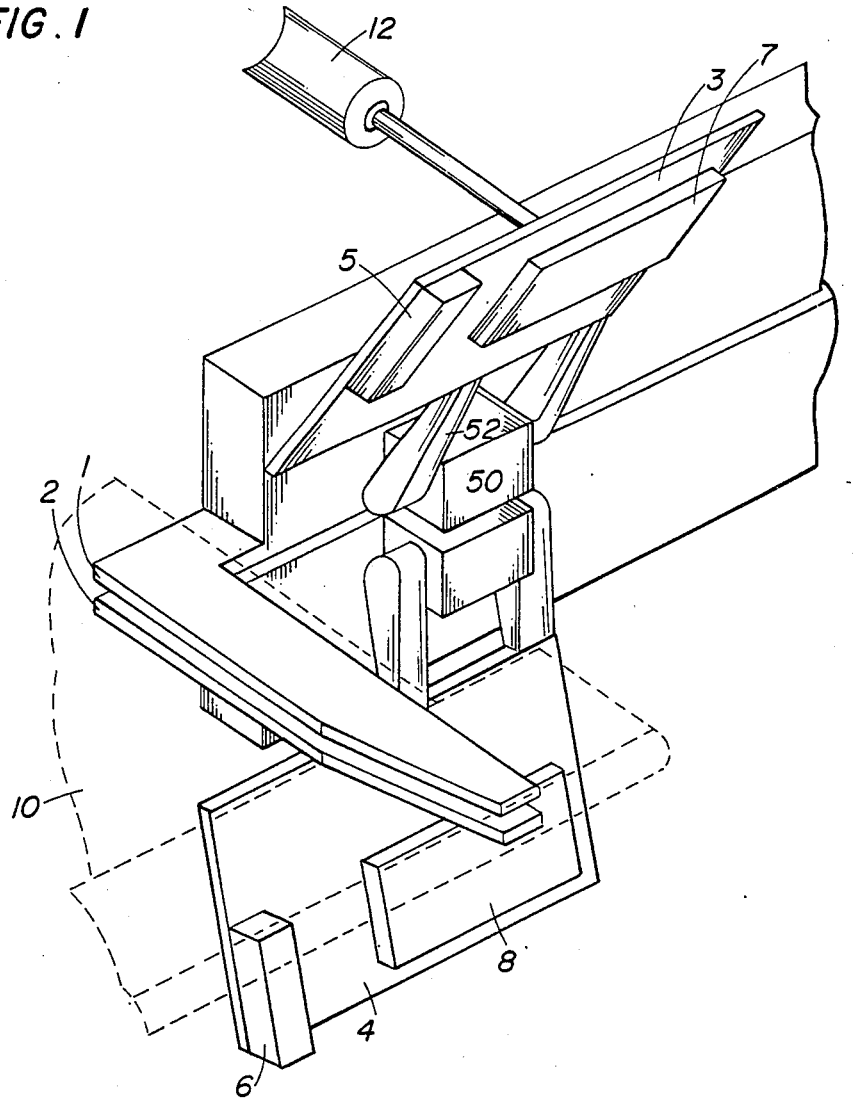
FIG. 1 is a partial top perspective view of a folding device having brackets which maybe moved away from the fingers and construction in accordance with the invention.
Figure 5:
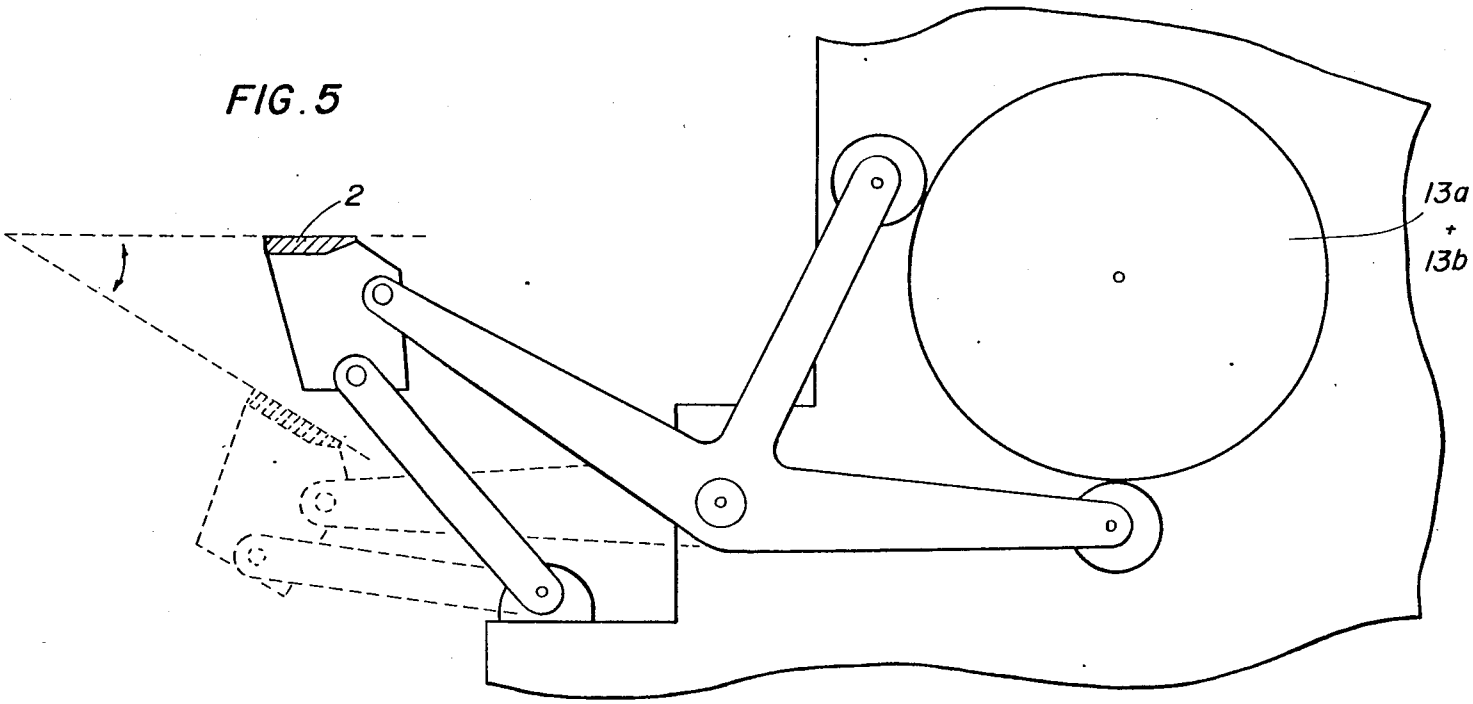
FIG. 5 is a simplified side view which shows the control for the lower finger.

In accordance with the invention the device includes first and second garment engagement fingers 1 and 2 in an arrangement where at least one of them for example finger 2 as shown in FIG. 5 are connected to means for moving them relative to each other from a close together unvirgin position as shown in FIG. 1 in which they may be inserted between the garments layers 10*a* and 10*b* or to a separated other position in which they diverge and are spaced upon to separate the garment layers for folding as shown in FIG. 2.

In accordance with the invention the device further includes second brackets 3 and 4 which have associated clamping tools 5 and 6 engageable with a garment layer over an associated finger 1 or 2. In addition the brackets 3 and 4 have respective folding projections 14 and 15 which are engageable with a garment layer and a folding tool 7 and 8 which are moveable in the direction of the arrow shown in FIG. 2 for facilitating the fold of each garment layer around the folding projection and an end of the associated finger 1 or 2 so that the garment is folded into an overlap waist forming addition. Mounting means including a support 50 and a pivot on 52 mount brackets 3 and 4 for pivotal movement as shown in FIG. 1 either towards or away from the associate fingers 1 and 2. Means such as a cylinder and piston 12 are provided to move the associated brackets 3 and 4.

In accordance to the feature of the invention the hold device including the fingers 1 and 2 maybe moved through association with the bar tacking machine 11 where they may be positioned between a pressor foot 16 so that the folded garment layers maybe secured together.

FIG. 1 show the fingers 1 and 2 of the folding device in a converged position. The brackets 3 and 4 on which the respective folding tools 7 and 8 and the clamping tools 5 and 6 are arranged and which are shown in a diverged position. FIG. 1 shows also the air-cylinder aggregate or fluid piston and cylinder 12 which controls the upper bracket 3. In the position of FIG. 1 described above the waistband end 10 with the attached garment part can be loaded. When the waistband end is loaded the fingers 1 and 2 are located in the inside of the waistband end and the automatical folding in process starts.

At first the brackets 3 and 4 coverage and the upper part of the waist band 10*a* and 10*b* and the lower garment part 10*b* are clamped between the upper finger 1 and the upper clamping tool 5 and the lower part of the waistband is clamped between the lower finger 2 and the lower clamping tool 6 as shown in FIG. 2. After the garment part and the waistband are clamped the fingers 1 and 2 are caused to diverge and the brackets 3 and 4 are moved in a way which guarantees that they do not change their position relative to the fingers.

The diverged position of the fingers is shown both in FIG. 2 and FIG. 3. In a preferred embodiment of the invention, the upper finger 1 is stationary and the diverging of the fingers is attained by moving the lower finger 2.

One possibility of controlling the lower finger 2 is by two control cams 13*a* and 13*b* which are arranged on the same axis is shown in FIG. 5.

FIG. 2 indicates the position of the garment part 10*a* and the waistband 10*b* relative to the fingers 1 and 2. The fingers 1 and 2 are in a diverged orientation as in FIG. 3. When the waistband end is opened by diverging the fingers, the folding tools 7 and 8 fold the waistband ends which protrude beyond the fingers 1 and 2 into the open waistband which are only partially indicated by broken lines.

Each bracket 3 and 4 is provided with a respective pointed portion 15 which is used to guide the folding tools 7 and 8 during the folding process and to secure the fold when the folding tools move back. After the folding the folding tools 7 and 8 move back to their start position (shown in FIG. 2).

Thereafter the fingers converge and the folded waistband ends are clamped between the fingers. Then the brackets 3 and 4 are moved away from the fingers in their diverged position, which guarantees sufficient frees space between the fingers 1 and 2 and the brackets 3 and 4. The whole folding device is now moved in a way that the fingers 1 and 2 insert the folded waistband end under the presserfoot 16 of the bar taking machine (11) as shown in FIG. 4. Then the presserfoot (16) clamps the waistband end and the fingers 1 and 2 are moved out of the waistband by moving the folding devices back to the start position. Then the waistband ends are sewn together by a bar tack (17).

We claim:

1. A device for producing waistbands on garments having layers which must fold adjacent therein to form overlapped areas to be secured together by a securing apparatus, comprising first and second garment engaging fingers, being connected to at least one of said fingers to move one relative to the other from a close together position in which they converge and in which they may be inserted between the garment layers into another position and with a diverge and are spaced apart separate the garment layers for folding, first and second brackets each having a clamping tool engageable with a garment layer over an associated finger and having a folding projection engageable with a garment layer for initiating a fold line, the folding tool associated with said brackets for effecting a fold over of each garment layer around a respective folding projection and garment engagement finger to fold garment to overlap and associated garment layer, and mounting means mounting said brackets for pivotal movement towards and away from said fingers, and means to move said brackets towards and away from said fingers, said fingers with the folded garment, being positionable in the securing apparatus securing the folder over portions of the garment together.

2. A device according to claim 1 including cam mains connected to said fingers and to said folding tools in selected movements.

* * * * *

UNITED STATES PATENT OFFICE

CERTIFICATE OF CORRECTION

Patent No. 4,699,302 Dated October 13, 1987

Inventor(s) Papajewski et al

It is certified that error appears in the above-identified patent and that said Letters Patent are hereby corrected as shown below:

On the Title Page, Item [73]

At the designation "Assignee" change name of assignee to read as follows: Pfaff Industriemaschinen GmbH

Signed and Sealed this

Nineteenth Day of April, 1988

*Attest:*

DONALD J. QUIGG

*Attesting Officer*

*Commissioner of Patents and Trademarks*